United States Patent [19]

Skidmore, Jr.

[11] 4,061,197

[45] Dec. 6, 1977

[54] METHOD AND APPARATUS FOR DRILLING IN PERMAFROST AND THE LIKE

[76] Inventor: Sam C. Skidmore, Jr., Box 470, Fairbanks, Alaska 99707

[21] Appl. No.: 629,387

[22] Filed: Nov. 6, 1975

[51] Int. Cl.[2] ..... E21B 1/06

[52] U.S. Cl. ..... 175/101; 175/17; 175/323; 175/394; 175/325; 175/422

[58] Field of Search ..... 175/92, 100, 101, 102, 175/103, 173, 394, 257, 422, 323

[56] References Cited

U.S. PATENT DOCUMENTS

| | | | |
|---|---|---|---|
| 1,343,902 | 6/1920 | Chapman | 175/394 X |
| 2,776,123 | 1/1957 | Snyder | 175/394 X |
| 2,999,572 | 9/1961 | Hinckley | 175/102 X |
| 3,219,131 | 11/1965 | Boyd | 175/173 X |
| 3,232,361 | 2/1966 | Haspert | 175/102 |
| 3,241,624 | 3/1966 | Rassieur | 175/257 |
| 3,463,254 | 8/1969 | Miller | 175/102 |
| 3,885,638 | 5/1975 | Skidmore | 175/390 |

*Primary Examiner*—Ernest R. Purser
*Assistant Examiner*—Richard E. Favreau
*Attorney, Agent, or Firm*—Charles W. McHugh

[57] ABSTRACT

A drilling assembly which is particularly adapted for drilling in regions of the earth having permafrost, comprising a relativey large earth auger including at least one helical flight which is welded to a long central tube. The upper end of the auger has a shape such that torque may be readily applied to the auger for rotating the same. Interiorly of the upper end of the tube is a means for mounting a downhole percussion hammer, such that the percussion hammer may be suspended for operation within the tube. Preferably, a substantially solid drill bit having a generally frustoconical (pointed) shape is used in conjunction with the percussion hammer. Also, a means for advantageously providing for admitting more compressed air to the bottom of the hole than would normally be admissible by relying on air supplied to the percussion hammer alone.

In another embodiment, the helical flight adjacent to the periphery of the tube is replaced by arc-shaped segments that are axially spaced and off-set with respect to each other along the tube. Cuttings which are blown part of the way out of a hole being drilled will tend to accumulate on top of these segments; lifting the apparatus out of the hole will naturally remove the captured cuttings.

9 Claims, 11 Drawing Figures

METHOD AND APPARATUS FOR DRILLING IN PERMAFROST AND THE LIKE

This invention relates generally to drilling holes in the earth's crust, and more particularly it relates to an auger-type drill apparatus which is complemented by a pilot percussion apparatus that is substantially smaller in diameter than the auger.

The construction of the so-called Alaskan Pipeline has recently focused attention on many problems with regard to drilling holes in the earth's crust. Of the many problems that have been faced on this project, some may actually be "old" problems that have existed for as long as man has tried to live in a region with continuous or nearly continuous permafrost. Permafrost, of course, is known to be perennially frozen ground, which occurs wherever the temperature remains below 0° C for several years. Such "old" problems presumably include how to dig a hole in the hard permafrost for setting a foundation or the like. A relatively new problem, however, is how to dig literally thousands of holes in the permafrost—and do it in a short period of time. This new problem was created by virtue of certain basic design decisions on how to anchor the planned pipe line to frozen earth, in view of the fact that it will be a very definite heat source as relatively hot oil flows through it. In order to prevent the hot oil in the pipeline from transmitting its heat to the underlying permafrost, it was decided to suspsend much of the pipeline in saddles or straps that extend between two vertical pilings, which pilings are known as vertical support members (or VSM's). A typical vertical support member is a steel pipe having a diameter of about 18 inches, securely set in a 24-inch diameter hole. The structural requirement that such vertical support members be provided approximately every 60 feet naturally means that there will truly be thousands of holes drilled during the construction of the pipeline. In the more southerly construction regions, the ground south of the continuous permafrost areas becomes sufficiently thawed in the summertime to permit more or less conventional drilling techniques to be employed; and large (24-inch) augers have been used to achieve at least some holes in these regions. The word "successful" cannot realistically be applied to such drilling techniques, however, because drilling one hole cannot necessarily be equated with the "economical" drilling of many holes. That is, there have been known instances in which a conventional auger has been able to drill less than 10 feet into permafrost before it has to be removed from the hole and sharpened or discarded; also, the consumed time to drill even 10 feet has been disappointing. One weak feature of a conventional auger seems to be the pilot blade which extends forwardly of the auger along the longitudinal axis thereof, and which has been particularly susceptible to wear. Such fixed blades have been especially hard to drive into the frozen permafrost, and they have also been quickly dulled by the frequent glacial boulders and rocks that are so widely distributed throughout Alaska. Of course, when such boulders are encountered admist the frozen dirt, gravel, etc., it might be possible to remove the auger from the hole, replace the auger with a percussion drill bit of the type usually employed in drilling in rock formations, and then use that bit to break up a boulder or drill through it. Having drilled through the boulder, however, it would then be necessary to again put the auger-type device back on the drill rig, and continue the drilling process until a desired hole depth (typically 30 feet) had been achieved. One reason that the auger has to be again installed on the rig is that previously known percussion drill bits (such as the type disclosed in U.S. Pat. Nos. 3,269,470 and 3,583,504, etc.) seem to be incapable of handling material like permafrost. Perhaps one reason is that ice is a very significant component of permafrost. Since the percussion action that attends the use of a percussion hammer will inherently generate heat, there is the opportunity for a large percussion hammer to heat up the permafrost immediately ahead of the bit by an amount sufficient to raise its temperature above the freezing point; but before any cuttings can usually be expelled from the hole, they tend to refreeze around the hammer and/or drill stem so as to lock the same in the hole. For this reason, then, conventional flat-head percussion drill bits, etc., have not been used with any notable success in Alaska. And, for essentially the same reason, an apparatus with rollers such as that shown in U.S. Pat. No. 2,873,093 would not be expected to be usable on the North Slope—because of the propensity of permafrost cuttings to freeze and lock up moving parts.

The problem of having cuttings freeze or stick to the drilling apparatus has also been noted even with basic auger devices, and it is frequently necessary to pull an auger drill out of a hole and manually knock frozen permafrost from the auger flight by use of axes, picks, and shovels. Also, to improve the initial loosening of the earth's crust immediately below the auger, it has been a common practice to provide sharp, protruding cutter bits at the forward edge of an auger's flights. Such bits are commercially available from companies such as Kennametal, Inc. at Bedford, Pennsylvania. Typically, these cutter bits (which are like sturdy fingers having carbide tips) are installed so that they are separated by a signifcant space in order to foster individual penetration into the ground. If the space between such cutter bits becomes filled with frozen permafrost, however, the effectiveness of the bits for penetration of virgin ground is completely negated. Hence, it is often necessary to manually chip away frozen pieces of permafrost from between adjacent cutter bits, when the auger drill is periodically removed from the hole. Once the auger drill has been freed of material that had stuck to it in the hole, it can be re-inserted into the hole and drilling can continue. But the time that is lost at the earth's surface in cleaning the auger drill is obviously non-productive time; and drill cleaning has the potential of causing the waste of many, many man-hours of time that could be more profitably used in advancing the completion of the pipeline.

In hopes of solving the problem of having to quickly drill thousands of pier holes in frozen and/or rocky ground, several solutions have been attempted. Among the attempts at drilling such pier holes has been the fabrication of bigger and heavier drilling rigs, many of which have cost in excess of one-half a million dollars each, and which are capable of applying torque in the amount of 85,000 foot-pounds and producing downhole loads of 40,000 to 80,000 pounds. Apparently the rationale behind the decision to try bigger and heavier equipment was that bigger and heavier would automatically be translated into faster drilling. But we all know that dinosaurs failed to survive on our earth in spite of their great size, and it has now been found that bigger and heavier rigs are not necessarily better—at least not in Alaska.

In spite of many well-intentioned endeavors to build relatively large drilling rigs, it has now been found that a faster technique for drilling holes in permafrost and the like can be employed with relatively light-duty drilling rigs—provided that appropriate use of compressed air is employed with a particular combination of an auger and a percussion hammer. Accordingly, it is an object of this invention to provide a means for meeting requirements such as exist on the Alaskan Pipeline project, e.g., drilling relatively large holes (about 24 inches in diameter) to a depth of 30 feet or so in the fastest amount of time and with the least wear and tear on equipment and personnel. Essentially, it has been found that holes can be rapidly drilled in Alaska with only modest down pressure and with relatively low torque by: (1) supplying a large quantity of compressed air to the bottom of the hole; and (2) using a percussion pilot drill along the longitudinal axis of an auger-type drill assembly. An exemplary apparatus for practicing the invention is shown in the drawings, in which:

Figure 8:
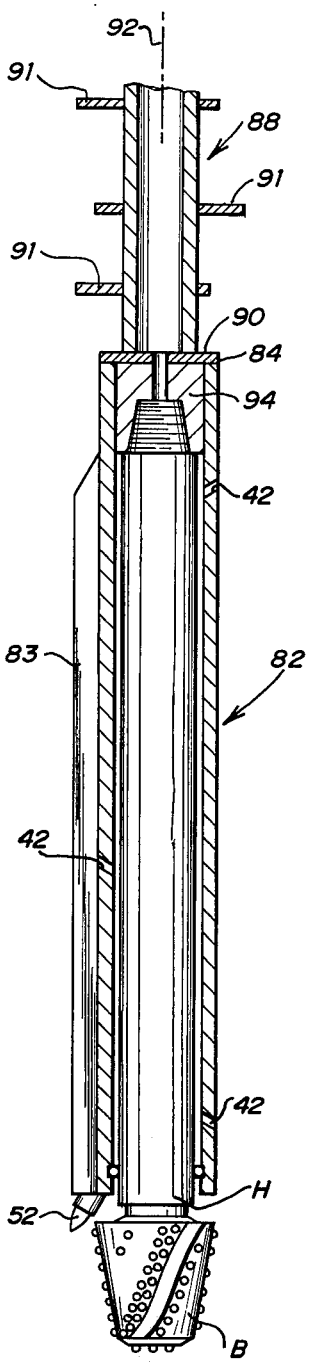
FIG. 8 is a cross-sectional view of another embodiment of a drilling apparatus, in which one or more flat lifting plates are used to remove cuttings from the hole being drilled.
Figure 9:
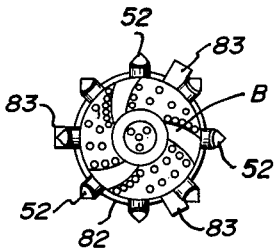
FIG. 9 is a front end view of the drilling apparatus shown in FIG. 8.
Figure 10:
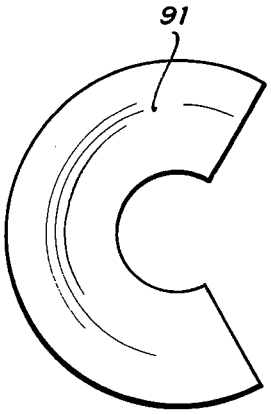
Figure 11:
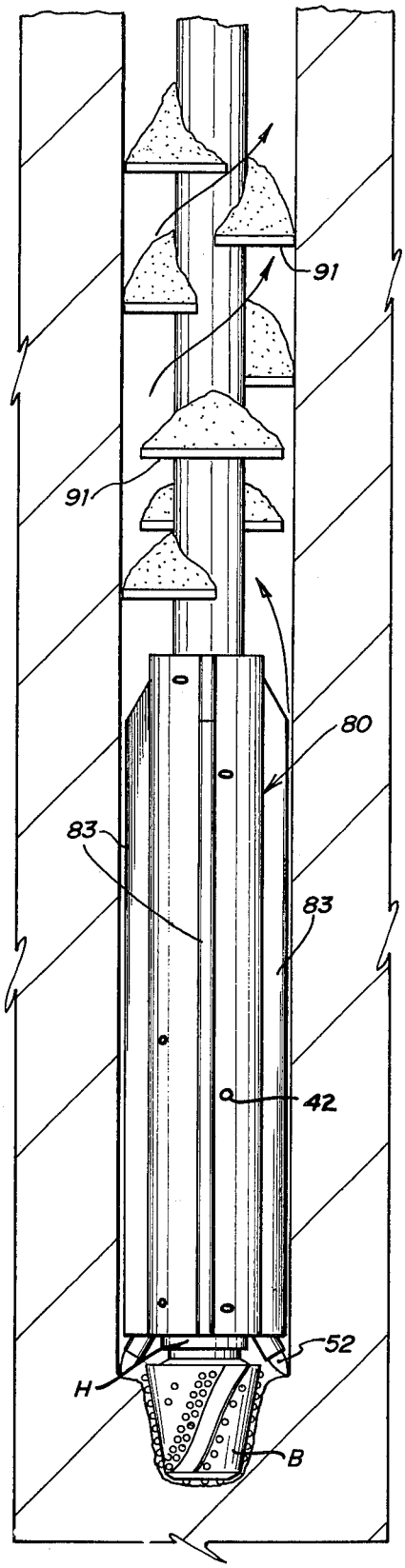

FIG. 10 is a top view of an exemplary lifting plate of the type that may be employed with the apparatus of FIG. 8, in order to increase the horizontal area for accumulating cuttings which are to bé lifted from the hole being drilled; and FIG. 11 is a sectional elevation view of the drilling apparatus shown in FIG. 8, with the tortious path for air-borne cuttings being apparent, and some cuttings being shown on top of the lifting plates—where they come to rest if there is not enough air being vented to below the cuttings out of the hole.

Figure 1:
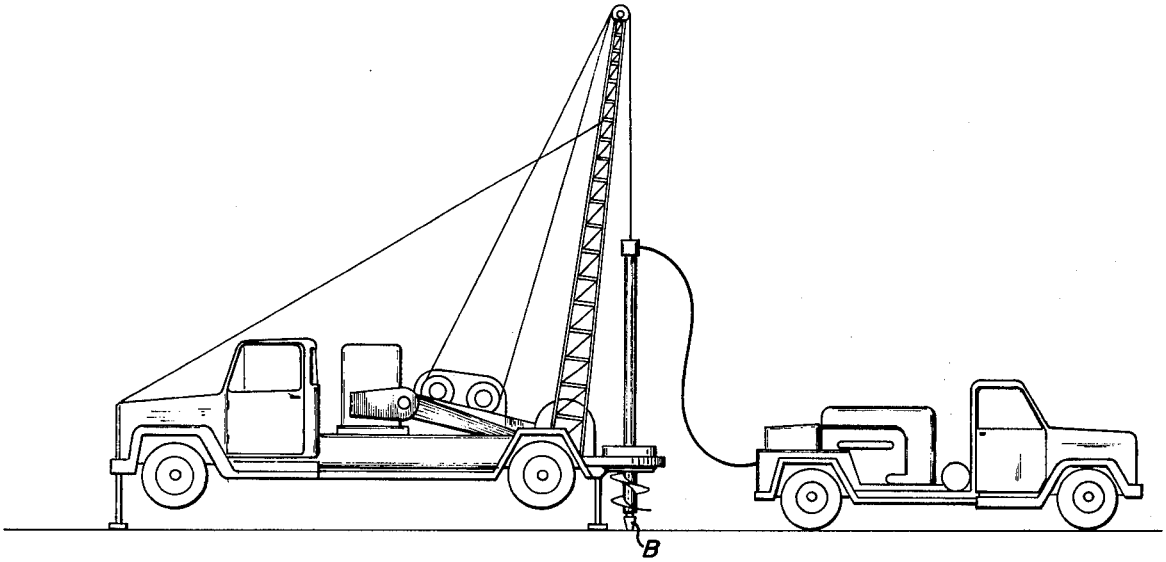
FIG. 1 is an elevational view of a truck-mounted drilling rig, with a source of compressed air illustrated in diagramatic fashion, with the compressed air being used in the optimized practice of the invention.

Referring initially to FIG. 1 a drilling rig mounted on the back of a truck in a conventional manner is shown parked at a location where its desired to drill a pier hole in the earth. The basic drilling rig through which torque is applied to a drill bit is fairly conventional in its external appearance; however, as will be explained more fully hereinafter, the size and weight of the drill rig can be relatively small—in comparison to previously known rigs for drilling large holes. That is, with the drill bit to be disclosed herein, it is not unusual to take a drill rig which is rated for drilling 8-inch diameter holes, and, using the techniques of this invention, successfully drill holes 2 or 3 times that size.

A primary addition to the conventional drill rig shown in FIG. 1 is a source of compressed air, typically a truck-mounted air compressor which is capable of supplying enough air at an appropriate pressure for powering a down-hole percussion hammer of the type commercially available from Ingersoll-Rand or Mission Manufacturing Co., etc. Such percussion hammers typically require at least 220 CFM of air at 100 psi; hence, this would be the minimum air supply that a person should have in order to practice the invention. Those skilled in the art will recognize that there is also a maximum quantity of air that can be utilized by such down-hole percussion hammers, which maximum is usually on the order of 600 CFM. That is, no matter how much compressed air might be available on the site, there has been a ceiling in the past on how much compressed air could be utilized. Further, orifices and chokes are frequently built into the hammer as a safeguard against admitting a quantity of air which is substantially in excess of the design quantity. In accordance with this invention, no effort is made to thwart the capacity limitations that are built into a percussion hammer; but provision is made for diverting at least some hot air from the compressor to the exterior of a percussion hammer in such a way that compressed air may be directed to the bottom of the hole for fostering the drilling process.

Figure 2:
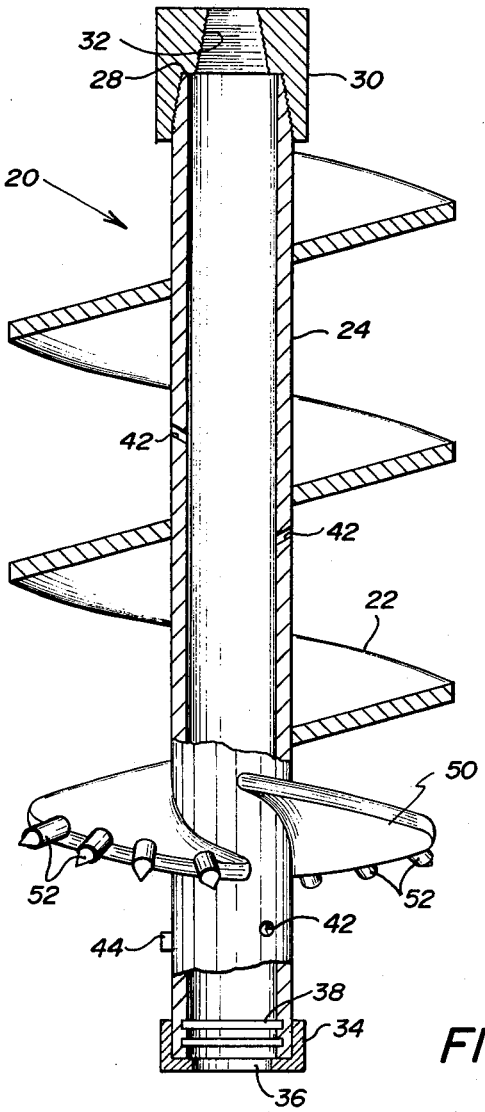
FIG. 2 is a front elevational view, partly in cross section, of an earth auger having a helical flight affixed thereto.
Figure 3:
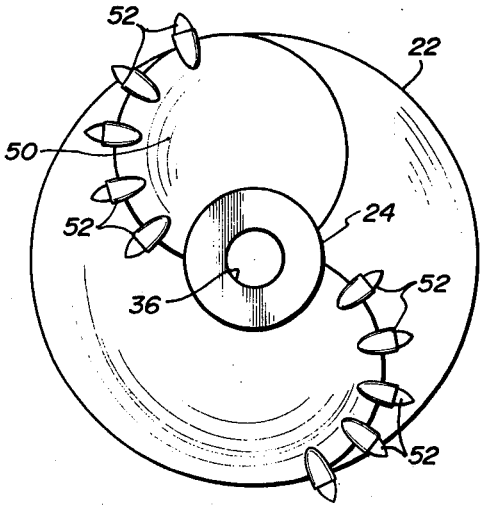
FIG. 3 is a front end view of the auger shown in FIG. 2.
Figure 4:
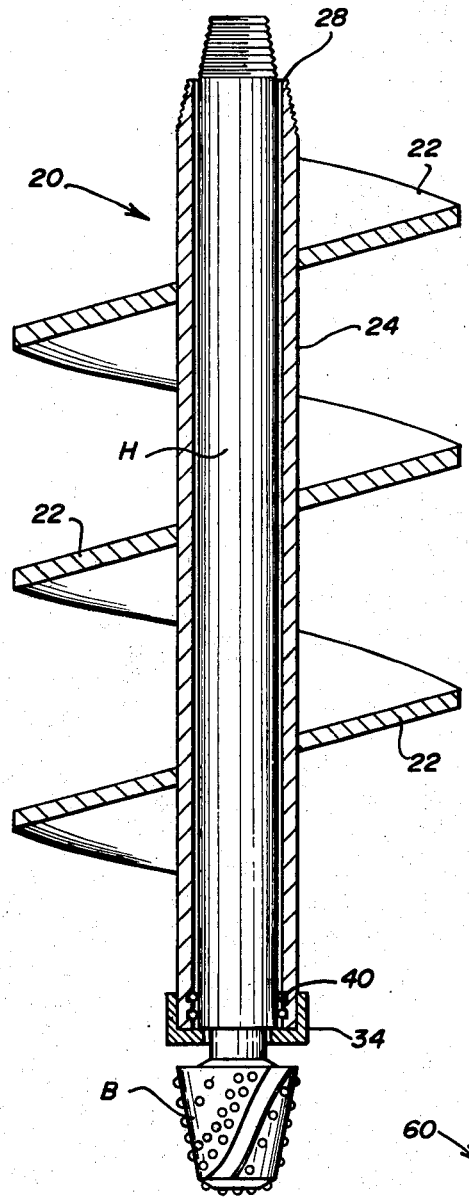
FIG. 4 is a view similar to FIG. 2 in which a down hole percussion hammer and a drill bit are shown in their mounted positions with respect to the central tube of the auger.
Figure 5:
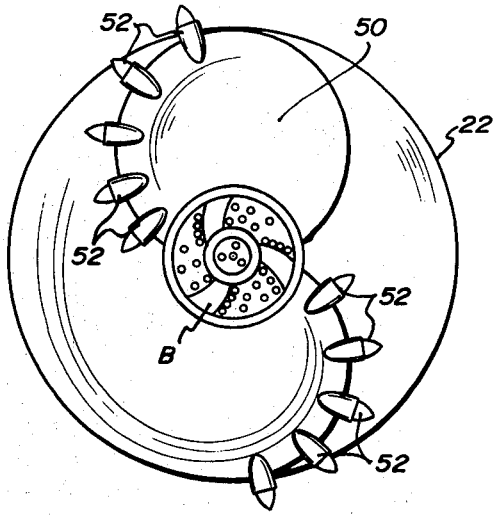
FIG. 5 is a front end view of the apparatus shown in FIG. 4.

Referring next to FIG. 2, one embodiment of the invention consists of an earth auger 20 having a helical flight 22 which is affixed (as by welding or the like) to a central tube 24. Of course, earth augers per se are well known; and like previously known augers, this auger has a means such as a square head at its upper end by which torque may be applied for rotating the same. When work was first commenced on the Trans-Alaskan pipe line project, efforts were made to use conventional augers to drill pier holes in the permafrost; such conventional earth augers, however, had solid central members instead of the hollow member 24 provided in this new auger. In this new style auger the tube's bottom end 26 is open (to present an exposed bore), such that the tube 24 may be slipped over an auxilliary earth-drilling mechanism in the form of a percussion hammer. In the tube's top end 28 there is also provided a structural means 30 for engaging the top end of a percussion hammer. Today's commercially available percussion hammers have either male or female threads, so the structural means will naturally include mating threads. If a different connecting means for a percussion hammer should ever be designed and built, however, an appropriate modification to the structural means could naturally be provided. In other words, the exact form that the structural means 30 takes is not critical, but it is necessary that there be such a means. Whatever may be the type of fastening technique employed, the structural element 30 will be expected to have an air passage 32 (which typically is coincident with the longitudinal axis of the tube 24) for passing air to a percussion hammer which is mounted internally of the tube.

As for the size of the central tube 24, it will be selected so as to have an inner diameter somewhat larger than the OD of a commercially available hammer; and, there will typically be a significant annular space between the tube 24 and a percussion hammer enveloped therein. In one embodiment of the invention, this annular space will serve as a manifold for delivering compressed air to the bottom of the hole, as will be explained hereinafter; but providing the annular space also means that the basic tube 24 is spaced from, and therefore would not inhibit the separation of a percussion hammer—if the threaded connection between the structural means 30 and the hammer should ever become disengaged in a hole. While the separation of a hammer and an auger in a hole that was only 30 feet deep would not necessarily mean the irrevocable loss of the hammer, it could well make retrieval of the hammer a frustrating job—even in temperate portions of the earth. And, in northern regions of the earth where permafrost exists, the rapid formation of ice around a percussion hammer that has accidentally dropped to the bottom of a hole can render the recovery of that hammer much more difficult. Accordingly, it has been found preferable to build in a safety feature against accidental loss of a hammer, said feature being a threaded collar or the like at the bottom end of the central tube 24. The threaded collar 34 has a central opening 36 which is large enough to permit a drill bit to extend therethrough and to freely oscillate (in a direction parallel to the longidutinal axis of the tube); but the opening is not large enough to permit the entire hammer barrel to pass therethrough. The advantage of this construction is that accidental disengagement of the hammer from the auger 20 will only cause the hammer to fall a short distance until it contacts the threaded collar; subsequently removing the auger 20 from the hole will then also remove the hammer.

Also provided in the central tube 24 near the bottom end thereof is at least one internal groove 38. This internal groove serves as a locating means for a sealing means such as an O-ring 40. Such an O-ring is sized in order to form an effective seal between the central tube 24 and the barrel of a percussion hammer which is installed in the tube. The reason for providing a sealing means is to preclude any cuttings that are generated in a hole from working their way upward into the annular space between the central tube 24 and the hammer barrel. If such cuttings were to be permitted free access to the annular space, they might eventually fill said space and prevent sufficient air from reaching the bottom of the tube. O-rings also serve to keep the hammer barrel centered in the tube 24, and—to the extent that they bind the barrel—they also hold the hammer and tube together.

The primary reason for wanting to keep the annular space free of cuttings is to insure that a plurality of vent holes 42 which extend through the sides of the central tube 24 do not become blocked off. As can be seen in the drawing, these vent holes 42 are located between the upper end of the central tube 24 and the sealing means 40; and any compressed air admitted to the annular space will naturally be vented through said holes. In order to provide some flexibility in the amount of air that is vented to the hole being drilled, it is preferred that at least some of the vent holes 42 be threaded, such that pipe plugs 44 might be inserted therein. By providing threaded vent holes, the number of operating holes may be varied at will by an operator, through the simple technique of inserting or removing plugs 44.

As for the exact configuration of the vent holes 42, the wall thickness of the tube 24 will likely be sufficient so that air passing out of a vent hole will have a very pronounced initial direction. That is, the air coming out of a tube 24 may be properly categorized as an air jet, in the sense that it has a very pronounced direction. And, preferably, the vent holes have axes which are skewed with respect to the central tube 24 in such a way that the air jets emerge from the holes in directions which are generally parallel to an adjacent helical flight. One reason for providing that the air jets extend along the helical flight is to foster the upward movement of cuttings along a flight and to inhibit the freezing of permafrost cuttings to the flight. That is, in the process of drilling through permafrost, some cuttings may experience some surface melting (as a result of the hot compressed air and/or the heat generated by the percussion blows from the hammer). As such cuttings move along the auger flight 22, they are subject to becoming frozen again; and, in the absence of a steady supply of heat, the cuttings can become solidly stuck to the auger. It will be seen, therefore, that the properly oriented vent holes (which will be discharging hot compressed air) can be advantageous if they inhibit the refreezing of cuttings to the flight 22. Also, by orienting at least some of the vent holes 42 generally upward, the cuttings from the hole tend to remain in a "fluidized" state as they move upward with the compressed air in its travel toward the earth's surface. Hence, the cuttings do not tend to "pack" as much with this apparatus as they do with prior art devices.

Figure 6:
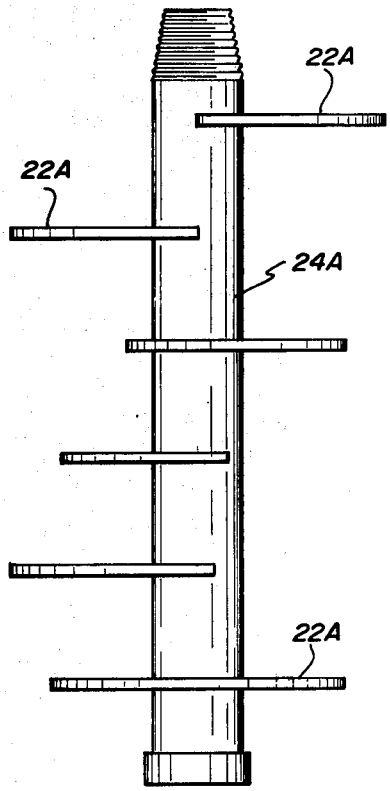
FIG. 6 is an alternate embodiment of a drilling apparatus in which several spaced and off-set plates are employed instead of a continuous helical flight.

As for the relative size of the flight 22 and the central tube 24, it is preferred that the flight diameter (i.e., its outside diameter) be at least twice as large as the inner diameter of the tube. Expressed another way, the ID of the tube 24 is preferably less than one-half the size of the auger flight 22, i.e., less than one-half the size of the hole being drilled. Furthermore, by keeping the flight member 22 relatively large, the ability of said member to lift cuttings out the hole (when the tube 24 is withdrawn) is enhanced. To elaborate on this, it should be noted that the helical flight member 22 will remove cuttings from the hole—in the manner of an auger—if the flight is as long as the hole is deep, and if the tube 24 is rotated for a sufficiently long period of time. However, a helical flight which is over 30 feet long is not particularly convenient to handle, and a much shorter flight—which is repeatedly "loaded" with cuttings and then removed from the hole—is a preferable construction. By physically removing the drilling apparatus from the hole after it is full of cuttings, there is no necessity to insure that cuttings will be carried in a continuous stream from the bottom of the hole to the top thereof. This periodic removal of the tool simplifies at least part of the process for removal of cuttings, and it also makes possible a simplification of the basic drilling apparatus. That is, it will be appreciated that a helical flight 22 may be considered to be an elongated strip of metal which is secured in a spiral fashion around a central tube. If this helical flight is constructed of materials so as to give it substantial strength, then it will be thick and heavy and somewhat difficult to form into the desired helix. An alternate, and much simpler construction, is shown in FIG. 6, wherein several plates 22A are affixed to the periphery of a tube 24A. Each such plate 22A extends outwardly from the tube 24A in a direction generally perpendicular to the longitudinal axis of the tube. Hence, lifting the tube 24A out of a hole being drilled will cause cuttings on top of the plate means 22A to be lifted out of the hole. In this respect, then, a series of serially arranged plates 22A may be considered to be one species of a lifting means, just as is a helical flight 22. Preferably, the plates 22A constitute two or more arc-shaped segments 22A having an internal boundary welded to the periphery of the tube. Said segments 22A are axially spaced along the tube 24A, and radially spaced with respect to each other, such that they would encompass substantially 360° as viewed from the end of the tube. Each such arc-shaped segment should be separated from its adjacent segment by at least 6 inches in order to foster the egress of air and the accumulation of cuttings; and each of the segments should encompass about 180°. By employing several such segments 22A on opposite side of the tube 24A, periodically lifting said tube out of the hole should cause the removal of substantial quantities of cuttings that had accumulated on top of the plates 22A. Those cuttings will have accumulated, of course, only if sufficient compressed air has been admitted to the bottom of the hole (below said segments 22A) at an appropriate pressure and in an appropriate volume in order to at least blow the cuttings high enough that they can subsequently be trapped on top of the segments 22A.

In the optimized practice of the invention, it is preferred that a particular style of percussion drill bit be mounted on the bottom end of the percussion hammer, with said preferred bit having a spiral or screw-type configuration as shown in U.S. Pat. No. 3,885,638 to Sam C. Skidmore. Such a spiral bit is particularly well adapted for combined rotary and percussive action—which is particularly efficacious in drilling holes in regions where permafrost is not continuous, i.e., regions where both hard and soft material is likely to be encountered. To perhaps better explain this, it has been observed during work on the Alaskan pipe line that some regions in Alaska have soil which is not frozen for a depth of several feet; but below a certain depth, permafrost (which is frozen) is encountered. Too, some regions have permafrost beginning right at the earth's surface and extending for several feet, below which the ground may not be frozen. And, scattered throughout the various regions, there are frequently found boulders, hard materials and rocks, etc. Hence, in attempting to drill pier holes to depths of 30 feet or so, a wide variety of soil conditions may be encountered. By virtue of having a spiral drill bit of the Skidmore type, there will be no necessity to repeatedly change bits as different material is encountered in a hole. If the material is relatively soft, a spiral Skidmore bit will turn in the manner of an auger, pushing cuttings away from the central axis of the bit toward the periphery of the auger flight 22, where the flight may effectively act on such cuttings to force them upward. If the soil conditions suddenly change from soft to hard, the percussion action provided by the hammer can permit penetration of the bit into the earth.

In order to gain the greatest advantage of the combination of the hollow auger 22 and a percussion bit of the type disclosed in U.S. Pat. No. 3,885,638, the percussion bit should have a maximum diameter which is approximately the same as the inner diameter of the tube 24. By restricting the bit diameter to no more than half the diameter of the auger flight 22, the percussion bit will also serve as a pilot member, which tends to keep the hole reasonably straight. A straight hole is also fostered by making the axial length of the helical flight 22 equal to at least twice the pitch of the flight. A common pitch for a flight is about 1 foot, and a flight length of about three feet is preferable to a shorter length. A single flight has been found to be adequate, but a short period flight 50 at the bottom of the auger 20 is also useful in keeping the hole straight—by insuring that torque which is applied to the auger is transferred evenly to both sides of the auger's longitudinal axis.

In a preferred embodiment of the invention for drilling holes having a 24 inch diameter, the diameter of the helical flight 22 will be 24 inches; and the tube 24 will have an OD of 7 inches and an ID to readily accommodate a percussion hammer having a barrel diameter of 5⅜ inches. A spiral drill bit in accordance with U.S. Pat. No. 3,885,638 would preferably have a maximum diameter of about 8 inches. The 24 inch flight will have a cross-sectional area of about 450 square inches; and the 8 inch drill bit will have a cross-section area (through the largest portion of the bit) of about one-eighth of the flight area. Hence, the area of the ground which is covered (i.e., shaded) by the relatively large flight—and which is subjected to percussion blows—will be about one-eighth of the area defined by the flight.

Additionally, the auger 20 is made more effective in drilling through the earth's crust by providing a plurality of widely spaced and downwardly facing "teeth" 52 which are secured to the bottom-most surface of a flight 22. Such teeth are preferably of the kind sold by the Mining Tool Group of Kennametal, Inc. of Bedford, Pennsylvania, which are typically available as an assembly of a block and a replaceable carbide-tipped bit. The block is generally welded to the bottom of a flight 22 with an orientation so that the bit will be pointed downward and forward, i.e., in the general direction that the auger 20 will be turning during a drilling operation. The hardened bits or teeth 52 will generally lie on a line which extends outwardly from near the central tube 24 to the periphery of the auger 20. Of course, such teeth have been used in the past for a similar purpose, i.e., digging ditches, trenches and holes in the earth's crust. But their use in drilling through permafrost in Alaska has been hampered by the fact that permafrost cuttings have frequently become frozen in the space between adjacent teeth 52, such that the teeth no longer protrude as individual an isolated members from the bottom surface of a flight 22. However, with the heat that is provided by the compressed air used in this new auger assembly, the freezing of permafrost cuttings to the auger has been a greatly reduced problem. Hence, more actual drilling time can be realized with an auger of this invention, because less time is spent at the surface in manually cleaning or clearing the auger of unwanted matter.

Figure 7:
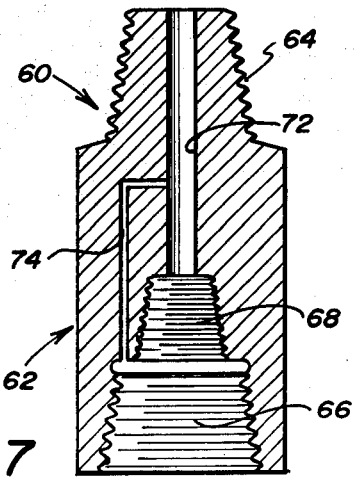
FIG. 7 is a cross-sectional view (through the longitudinal axis) of a top sub which is useful in furnishing extra compressed air to the drilling apparatus, i.e., compressed air that normally could not be supplied to the bottom of the hole through a percussion hammer.

At an earlier place herein, mention was made of the fact that it has been found to be advantageous to supply extra air to the bottom of the hole, that is, air that is not inherently supplied to the hole through operation of a percussion hammer. Referring next to FIG. 7, an important element 60 for supplying this extra air will now be described. This element 60 will be referred to herein as a "top sub", for the reason that it has some similarity to the subs which are well known for connecting drill strings together in oil fields. This new sub 60, however, are distinguishable from previously known devices in having at least two air passages therethrough, one of which is adapted to supply air internally to a percussion hammer and the other passage being adapted to supply air externally of the hammer. The sub 60 includes a generally cylindrical element 62 having a means such as API threads at a first end 64 for engaging the end of a drill pipe or the kelly K of a drill rig. Of course, it is immaterial whether the torque for operating the auger 20 is supplied directly from the kelly, or is supplied from the kelly to an intermediate drill pipe and then to the sub 60; the operation of the auger will be the same in either case.

In the second end of the cylindrical element 62 is provided a relatively large bore 66 which is provided with internal threads for engaging the top end of the central tube 24. A counterbore 68 is also provided in the second end, and it is provided with threads 70 of a size and type so as to engage a pneumatic hammer H of the conventional type used in drilling through the earth's crust. An axial air passage 72 extends longitudinally through the cylindrical element 62 for supplying compressed air to the pneumatic hammer H. A second air passage 74, which may be a branch passage beginning above the threads 70, is provided for passing air through the element 62 to an internal location (i.e., a part of the bore 66) which is external of the pneumatic hammer H. It will be apparent, therefore, that a given quantity of air which is admitted at the element's first end 64 may be distributed partially to the hammer H through the central passage 72 and partially along the exterior surface of said hammer—provided that the hammer barrel does not completely fill the bore 66. The extent to which air will flow though the passage 74 (and externally of the hammer H) will naturally be a function of the size and quantity of the air vents 42 provided in the tube 24. That is, providing a large quantity of open vents 42 can cause a substantial amount of air to flow through passage 74; filling some of the air vents 42 with lugs or the like will naturally inhibit the flow of air though said passage.

By providing two or more top subs 60 with different axial spacing between the first end 64 and the threaded counterbore 68, the relative position of a drill bit B ahead of the auger 20 may be adjusted by changing subs. Thus, the drill bit may be set at, say, 6, 12, or 18 inches ahead of the lowermost portion of a helical flight 22. A preferred distance for such protrusion of the drill bit B ahead of the auger's flight is about 18 inches for a 24-inch diameter auger.

Referring next to FIG. 8 another embodiment of an apparatus for drilling holes into the earth's crust is shown. This apparatus 80 includes a first tube 82 which has a length of about three times its diameter, with said length being particularly useful in order to foster straight drilling of a hole in the ground. To the extent that it fosters straight drilling, it "stabilizes" the direction of the hole; hence, the tube 82 is aptly called a stabilizer tube. If the length of the tube 82 was made shorter, e.g., only about as long as it is wide, then there would be a greater possibility of the hole deviating from a straight line—especially when there are rocks or the like scattered through the soil that would tend to make the apparatus become diverted from its original course. The stabilizer tube 82 has a top end 84 and a bottom end 86, and preferably has a substantially uniform body therebetween. The diameter of the tube 82 will typically be only slightly smaller than the diameter of the hole which is to be drilled.

A torsion member 88 (which may be a round or square tube, or any other shape for effectively transmitting torque) is affixed to the top end of the stabilizer tube for applying torsional loads to the tube 82. The torsion member 88 has a cross-sectional area which is appreciably less than the size (diameter) of the hole to be drilled, such that there is substantial clearance between it and the walls of the hole. Also mounted at the top of the tube 82 is a lifting plate 90 which has an inclination that is substantially perpendicular to the tube's longitudinal axis 92. Thus, when the tube 82 is pulled out of a hole being drilled, any cuttings that may be resting on top of the lifting plate 90 will be pulled upward. Once the lifting plate 90 has cleared the hole, rapidly rotating the tube 82 will cause any cuttings resting on the plate 90 to be thrown radially off, where they will usually accumulate around the hole just as in conventional drilling.

Internally of the stabilizer tube 82 is provided a structural means 94 for mounting a percussion hammer within said tube, such that a percussion drill bit may be operated against that portion of the earth below the tube 82. A means is also provided for supplying a relatively large quantity of compressed air to the interior of the tube 82. An air compressor at the surface will typically be the preferred manner of generating compressed air; and, if enough air is available, an air diverter 96 can deliver some air directly to the longitudial axis of the percussion hammer and some air alongside the hammer. A plurality of peripheral holes in the sides of the tube 82 can be used for venting "side" air out the sides of the tube. Also, a plurality of cutting teeth 98 are peferably distributed across the bottom of the tube 82, such that they may contribute to the generation of cuttings when the tube 82 is rotated in the hole. With the judicious placement of vent holes in the tube 82, such cuttings as are generated will be blown upward from the bottom of the hole, and such cuttings will typically rise to a height that is a function of the quantity of air being vented at the bottom of the hole as well as the velocity of said air. When the vented air is incapable of propelling cuttings to the earth's surface, the cuttings will typically fall back down the hole until they come to rest on top of the lifting plate 90. From time to time, it is appropriate that the entire apparatus 80 be pulled from the hole, so that the lifting plate 90 can be cleared of those cuttings which have come to rest on its top. In this respect, the apparatus 80 is equivalent to the previously described auger—since both the auger and the stabilizer are pulled out of the hole from time to time, so that they may be cleared of cuttings. With the apparatus 80, however, there are no helical flights in which permafrost may become frozen. And, while the helical flight which is shown in FIG. 2 does have a hole-stabilizing effect, it is not nearly as effective as the cylindrical tube 82. For drilling very deep holes, such as for water wells of 500 or so feet, the cylindrical tube 82 would typically have a length of about 20 feet.

In operation of the various embodiments, it will first be appropriate to arrange for an ample source of compressed air, e.g., at least 600 cfm at about 150 psi. Such a supply of compressed air would be a normal requirement for use of a downhole percussion hammer. However, in order to be prepared for most any soil condition that might be encountered, a prudent step would be to have on site an even larger source of air. For drilling 24-inch holes, a source of 1200 cfm of air at 150 psi is preferred; this will provide about 600 cfm for routine hammer operation and leave about 600 cfm for venting in the bottom of the hole in various directions. Having access to a relatively large air compressor on the Trans-Alaskan pipeline project has not been an obstacle, and there are even several 2000 cfm compressors available on this project. The venting of a large quantity of pressurized air must be handled with some caution, however, because too much air at the wrong time and the wrong place can constitute a possible safety risk to workers who must be near the hole being drilled.

In the actual drilling of a hole with an apparatus like that shown in FIG. , it is common to begin to pass compressed air through a percussion hammer and the attached drill bit when the tip of the drill bit first makes contact with the earth's surface. The fluidizing effect of a downwardly directed jet of air on relatively loose earth is frequently manifested by the raising of the earth's surface around the bit by a few inches. A modest amount of down loading on the auger 20 would then be applied, and torque would be applied to the top of the auger to cause it to burrow into the earth. After the auger has been twisted into the ground for the full length of the helical flight 22, the entire apparatus is typically pulled straight up out of the hole. With the helical flight being completely removed from the hole, the auger 20 is then rapidly rotated for a short time, in order to throw off the cuttings which were lifted from the hole. If necessary, a worker with a shovel might contribute some manual labor toward returning the auger to a "clean" condition; but the relatively hot air being vented at the bottom of the bit and along the sides of the tube 24 will normally prevent permafrost cuttings from re-freezing to the tube and/or helical flight. Once the auger has been cleared of cuttings, it is ready to be re-inserted into the earth, where the process of digging a few feet and then removing the auger is repeated. A preferred rotational speed for an auger 20 is within the range of about 15 to 35 rpm. Those familiar with efforts by others to drill pier holes in Alaska will recognize that this is relatively slow. Indeed, many drill rigs are not adapted for going any slower than 30 rpm; so the slower speed that is preferred with this invention is at least one thing that distinguishes this drill from prior art techniques.

With regard to the speed of advancement of the auger into the earth, a customary drilling speed would be about 1 foot per minute, in soil with significant resistance. Thus, the ratio of rotational speed of the auger (as measured in rpm) to the advancing speed of the drill bit (as measured in feet per minute) is preferably about 15:1.

If the auger 20 should suddenly encounter a boulder admist the gravel, soil, permafrost, etc., the percussion drill bit in the center of the auger 20 will normally cause complete fracture of the boulder—or at least sufficient fissures as to weaken the boulder—so that the helical flight is not substantially impeded in its progress. Too, it is probably true that the high pressure air being vented through the drill bit is of substantial advantage in converting small fissures in brittle materials into more significant cracks. Hence, it is believed that the combination of an auger and an air-operated percussion hammer is a particularly efficacious combination for drilling in permafrost and the like. The air being vented in the bottom of the hole is also particularly advantageous in keeping the cuttings somewhat loosely suspended in the hole. For example, in one experiment a 24-inch auger was being easily turned in the hole with about 9000 lb-ft. of applied torque at the same time that 250 cfm of air was being supplied; turning off the air caused the auger to be immediately over-loaded, and the kelly could no longer be turned. Promptly restoring the venting of compressed air made it possible to again rotate the auger, with the same power setting on the engine that had been ineffective in the absence of vented air.

When there is a desire to increase the quantity of vented air beyond that quantity normally supplied to a percussion hammer, one or more plugs 44 can be removed from their respective vent holes 42. This will permit some air to pass through the top sub and be vented to the hole without passing through the hammer. This extra air will not only foster the upward movement of cuttings along the flight 22, its heat will also tend to provide a very slight amount of surface melting on permafrost cuttings. Thus, with a controlled amount of heating, the water that is generated by slightly heating chunks of permafrost serves as an effective lubricant to help move the cuttings upward. However, some discretion must be employed in furnishing heat to a hole being drilled, because too much melting could turn the hole into something approximating a deep mud puddle. In practice, it has not been particularly difficult to avoid over-heating, and cuttings usually have sufficient structural integrity as to be removed from the hole in "chunks".

The relative position of the percussion hammer ahead of the leading edge of the flight 22 can be adjusted by selection of a top sub having a desired length. A preferred distance for the leading edge of a percussion drill bit ahead of a helical flight is about 18 inches when the auger flight has a diameter of 24-inch.

It should perhaps be noted that the percussive blows imparted to the drill bit by the pneumatic hammer H are not directly applied to the cutting teeth 52 on the helical flight. That is, the force applied through the anvil of a percussion hammer is applied solely to driving the drill bit forward. Hence, the basic percussion blows are effective in a central area which is a relatively small portion of the area shaded by an auger flight. However, there is an application of Newton's third law in this construction; of course, that law states that when one body exerts a force on another body, there is an equal and opposite reactive force. In the apparatus shown in FIG. 2, the reactive force on the anvil will inherently tend to elevate the auger 20 with respect to the hole being drilled, as each blow is delivered to the central drill bit. This reaction force will be in opposition to the down-loading on the auger imparted by the drill rig. And, by virtue of the efficacious use of air in contributing to the drilling process, the actual down-loading on the auger will typically be much less than on comparable devices, such that an exact balance between the downward force on an auger and the reactive force from the percussion hammer may frequently be achieved. In some cases, the reactive force may well overcome the down-loading on the auger, such that the auger itself may be momentarily lifted upward away from the bottom of the hole. When this happens, the teeth 52 are themselves caused to impart percussive blows on the bottom of the hole, as they drop back down in the hole after the reaction blows have been dissipated. While utilizing the teeth 52 as percussive members as well as cutting (or tearing) members was not an original part of the first prototype that was designed, it is believed that the reactive forces from the hammer that contribute to this percussion side-effect is a highly beneficial effect.

In operation of the embodiment shown in FIG. 8, the use of compressed air and the percussion hammer will be substantially the same. However, it will likely be desirable to supply considerably more compressed air to the bottom of the hole (through a variety of vent holes 42), because the operation of this embodiment depends more heavily on the use of air to elevate cuttings to a height such that they can be trapped on top of the lifting plates 90; the cuttings are subsequently removed from a hole by lifting the entire apparatus from the hole. Of course, cuttings that are trapped above the stabilizer tube do not fall back into the region where active cutting is going on. Hence, capturing the cuttings at an elevated location precludes them from impeding operation of the percussion drill bit in the bottom of the hole. Too, the drilling apparatus 80 is less apt to become wedged or stuck in the bottom of the hole—if cuttings are removed from the active cutting region around the apparatus.

The downhole force applied to the apparatus 80 will typically be about the same as the force applied to the embodiment of FIG. 2, i.e., a maximum of about 2000 lbs. The torque applied to the apparatus 80 will be probably no more than about 3,000 foot pounds; this torque is relatively small, of course, in comparison to the torque available from some of the mammoth drill rigs that have been built for the express purpose of drilling pier holes and the like in permafrost. By virtue of the efficiency of the drilling apparatus disclosed herein, a much lighter and more economical drill rig can produce holes in the earth much faster and more economically.

While only the preferred embodiments of the invention have been disclosed in great detail herein, it will be apparent to those skilled in the art that modifications thereof can be made without departing from the spirit of the invention. Thus, the specific structures shown herein are intended to be exemplary and are not meant to be limiting, except as described in the claims appended hereto.

What is claimed is:

1. An article of manufacture, comprising:

a. an earth auger consisting of a helical flight which is affixed to the exterior of a central tube, with the upper end of the auger having means by which torque may be applied for rotating the auger, and the bottom end of the tube being open to present an exposed bore, and the internal diameter of the tube being slightly greater than the outer diameter of a downhole percussion hammer to be accommodated therein, so that the tube may receive an auxiliary earth-drilling mechanism in the form of a percussion hammer, and there being a thin annular space between the hammer and the central tube; and b. structural means located internally of the tube at the top end thereof for engaging threads at the top end of a downhole percussion hammer, such that a percussion hammer may be threadably engaged as a self-contained unit with respect to said central tube, and said structural means further having a central longitudinal bore for passing compressed air from an external source to a central opening in the end of the downhole percussion hammer, whereby the single act of providing relative rotation between the central tube and the percussion hammer will serve both to join the two elements structurally and to establish a flow path for compressed air to the hammer.

2. The article of manufacture as claimed in claim 1 and further including a threaded collar at the bottom end of the central tube, and said threaded collar having a central opening which is large enough to permit a drill bit extending therethrough to oscillate, but not large enough to permit the entire hammer to pass therethrough, whereby the accidental disengagement of the hammer from the top end of the central tube will not result in loss of the hammer in a hole being drilled.

3. The article of manufacture as claimed in claim 1 wherein the outside diameter of the flight is about 24 inches and the inside diameter of the tube is about 5 inches.

4. The article of manufacture as claimed in claim 1 and further including at least one internal groove in the central tube near the bottom end thereof, and further including a sealing means in said groove to form a seal between the central tube and a percussion hammer which is installed in the tube, whereby cuttings generated in a hole can be prevented from working their way upward into the annular space between the central tube and the hammer.

5. The article of manufacture as claimed in claim 4 and further including a transverse passage in the top end of said central tube for passing compressed air from an external source through the upper end of the central tube and externally of the downhole percussion hammer, such that at least some compressed air may be transferred to the interior of the tube without passing internally of the percussion hammer, and including a plurality of vent holes extending through the sides of the central tube, with said vent holes being located between the upper end of the central tube and the sealing means, whereby air admitted to the annular space between a pneumatic hammer and the central tube may be vented through said holes.

6. The apparatus as claimed in claim 5 wherein at least some of said vent holes are skewed with respect to the central tube, such that air jets which emerge from the holes have a direction which is generally upward and parallel to an adjacent helical flight, whereby the upward movement of cuttings along a flight is fostered.

7. An article of manufacture, comprising:

a. an earth auger consisting of helical flight which is affixed to the exterior of a central tube, with the upper end of the auger having means by which torque may be applied for rotating the auger, and the bottom end of the tube being open to present an exposed bore, so that the tube may internally receive an auxiliary earth-drilling mechanism in the form of a percussion hammer, with there being a thin annular space left between the hammer and the central tube, and further including at least one internal groove in the central tube near the bottom end thereof, and there being a sealing means in said groove to form a seal between the central tube and a percussion hammer which is installed in the tube, whereby cuttings generated in a hole being drilled can be prevented from working their way upward into the annular space between the central tube and the hammer;

b. structural means located internally of the tube at the top end thereof for engaging the top end of a percussion hammer, and said means having a first passage for passing compressed air from an external source to the percussion hammer, and having a second passage for passing compressed air from an external source to the interior of the central tube but externally of the percussion hammer; and c. a plurality of vent holes extending through the sides of the central tube, such that air admitted to the annular space between a percussion hammer and the central tube may be vented through said holes, with at least some of the vent holes being downwardly inclined so as to create downwardly directed air jets as compressed air exists from said holes.

8. A drilling assembly which is particularly well adapted for drilling holes in the earth's crust, comprising:

a. a relatively large earth auger consisting of at least one helical flight which is welded to a long central tube, with the upper end of the auger having means through which torque may be applied for rotating the same, with the auger having a given outer diameter and the tube having a given inner diameter, and the tube extending below the lower-most edge of a helical flight by about 8 inches;

b. a downhole percussion hammer which is adapted to drive a drill bit axially and also to rotate the same, with the outer diameter of the percussion hammer being just slightly less than the inner diameter of the auger tube, whereby the percussion hammer may be suspended within the auger tube for operation therein;

c. a substantially solid drill bit having a generally frustoconical shape, and the drill bit being connected such that it may be driven by the percussion hammer, with the drill bit being mounted ahead of the auger, and the diameter of the auger flight being at least 3 times the maximum diameter of the solid drill bit; and d. cutting means mounted on the lower end of the helical flight for cutting into the earth's crust when the auger is rotated about its longitudinal axis.

9. The drilling assembly as claimed in claim 8 and further including means for adjusting the relatively position of the percussion hammer in the tube, such that the relative position of the drill bit ahead of the auger may thereby be adjusted.

* * * * *